United States Patent [19]

Goessler et al.

[11] Patent Number: 5,004,892

[45] Date of Patent: Apr. 2, 1991

[54] RADIANT ELEMENT

[75] Inventors: Gerhard Goessler, Oberderdingen; Eugen Wilde, Knittlingen; Rolf Seeburger, Sulzfeld, all of Fed. Rep. of Germany

[73] Assignee: E.G.O. Elektro-Gerate Blanc U. Fischer, Fed. Rep. of Germany

[21] Appl. No.: 443,559

[22] Filed: Nov. 29, 1989

[30] Foreign Application Priority Data

Nov. 30, 1988 [DE] Fed. Rep. of Germany ..... 3840360

[51] Int. Cl.[5] ..... H05B 3/74

[52] U.S. Cl. ..... 219/464; 219/466; 219/448

[58] Field of Search ..... 219/448, 464, 465, 466

[56] References Cited

U.S. PATENT DOCUMENTS

| | | | |
|---|---|---|---|
| 4,639,579 | 1/1987 | Brooks | 219/464 |
| 4,700,051 | 10/1987 | Goessler et al. | 219/464 |
| 4,764,663 | 8/1988 | Scott | 219/448 |
| 4,789,772 | 12/1988 | McWilliams | 219/448 |

FOREIGN PATENT DOCUMENTS

| | | |
|---|---|---|
| 0176027 | 9/1985 | European Pat. Off. . |
| 0164900 | 12/1985 | European Pat. Off. . |
| 0223503 | 5/1987 | European Pat. Off. . |
| 3318911 | 12/1983 | Fed. Rep. of Germany . |
| 3411965 | 10/1984 | Fed. Rep. of Germany . |
| 3503648 | 4/1986 | Fed. Rep. of Germany . |
| 3526892 | 2/1987 | Fed. Rep. of Germany . |
| 3437726 | 5/1988 | Fed. Rep. of Germany . |
| 3726535 | 2/1989 | Fed. Rep. of Germany . |

*Primary Examiner*—Teresa J. Walberg

*Attorney, Agent, or Firm*—Eckert Seamans Cherin & Mellott

[57] ABSTRACT

A radiant element (11) contains a light radiator, e.g. a substantially circular halogen tubular lamp (15) and a dark radiator (18) in the form of standard open, electric radiant heating coils. For damping or attenuating the high starting or transient current of the light radiator (15), a damping resistor (21) is connected in series therewith, namely during the warming-up phase of the light radiator (15). Following the rise of the resistance of the light radiator due to its heating or after a certain time lapse, a damping switching device (22) disables the series resistor by shorting across it.

7 Claims, 2 Drawing Sheets

RADIANT ELEMENT

BACKGROUND OF THE INVENTION

1. Field of the Invention

The invention relates to a radiant element, particularly for glass ceramic hotplates, with an electrical light radiator and at least one series resistor.

2. Prior Art

Such radiant elements are e.g. known from U.S. Pat. No. 4,700,051. The light radiator is an electrical heating resistor, which is heated to a much higher temperature (above 1500° K. and preferably above 2000° K.) than the standard heating resistor coils, which operate at a temperature below 1500° K. and are referred to hereinafter as dark radiators, although they also operate in the red heat range. The light radiators are usually encapsulated in an inert gas atmosphere, e.g. in quartz glass bulbs or tubes and are in part provided with means to counteract or cancel out material evaporation, e.g. by a halogen filling.

A problem in connection with light radiators is the high positive temperature coefficient of resistance, which leads to extremely high and in part, inadmissible starting or transient currents on operating the light radiator alone. Thus, U.S. Pat. No. 4,700,051 provides for a series connection of a series resistor constructed as a dark radiator connected in series with the light radiator, which attenuates or damps the starting current and in operation as a dark radiator supplements the power delivered by the light radiator. Thus, the entire installed capacity can be distributed over the light radiator and the dark radiator, which is in particular advantageous in the hitherto conventional arrangement of the light radiator in straight bars for filling the entire heated zone.

In the case of very high light radiator power levels this still becomes problematical, because in spite of the series resistor the starting current is too high and consequently inadmissibly loads the mains.

An object of the present invention is therefore to provide a radiant element, which ensures an admissible starting current in light radiators for all the power ranges.

According to the invention this object is achieved by a temporarily acting attenuation device or damping device for acting on the light radiator.

The attenuation device preferably switches on the series resistor during the warming-up phase of the light radiator and advantageously is automatically switched off again following heating of the light radiator. It can operate as a function of the voltage drop at the light radiator which, due to the positive temperature coefficient, increases following its heating. It is possible to provide a threshold value switching device responding to the voltage drop and which can comprise a relay. However, it is preferably constructed as an electronic circuit which, on reaching a given voltage value, trips and brings about the disconnection of a series resistor. In order to avoid switching transients caused by voltage changes, the activation, i.e. the signal tripping the reconnection of the series resistor, can be initiated by the complete disconnection of the voltage, e.g. by a separate isolating switch.

However, the attenuation device can also comprise a delay circuit, i.e. a timing element, because conventionally the warming-up phase of a radiant element is very short and only last 1 to 2 seconds.

The series resistor can be a separate damping resistor, which is consequently disconnected during further operation. Due to the fact that the resistor is not exposed to permanent loads, it can be subject to a high loading and can therefore be small and simply constructed. However, it is preferably located in the vicinity of the radiant element, in order to be able to dissipate the heat produced by it and at the same time utilize the same.

Particularly in the case of two-circuit radiant elements, i.e. radiant elements having several, individually switchable heating zones, e.g. two heating zones concentric to one another, it is also possible to connect in series with the light radiators the dark radiators normally provided as permanent heating means in the form of series resistors across the attenuation device. Each of the dark radiators could be connected in series with a different light radiator than in the working circuit thereof, or they could also be switched in other combinations. Thus, e.g. the series resistors of both heating zones could be connected in series with a single light radiator or the dark radiator of one heating zone could be connected in series with the light radiator of the other.

In the case of all radiant elements, which incorporate a light radiator, the invention leads to a reduction of the starting current to an admissible value which, without the measures of the invention, can be in part about a power of ten over the working current and which would otherwise bring about inadmissible mains loading due to its short nature and surge-like occurrence. This more particularly applies if the control or regulation of the radiant element takes place by a timing cycle, e.g. by regulators or switches operating in power cycles of different relative on-times.

These and further features of preferred developments of the invention can be gathered from the claims, description and drawings. The individual features, either alone or in the form of subcombinations, can be realized in an embodiment of the invention and in other fields and represent advantageous, independently protectable constructions for which protection is hereby claimed.

BRIEF DESCRIPTION OF THE DRAWINGS

An embodiment of the invention is described hereinafter relative to the drawings, wherein are shown.

DETAILED DESCRIPTION OF THE PREFERRED EMBODIMENTS

Figure 1:
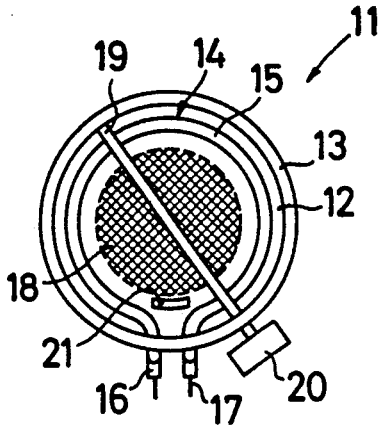
FIG. 1: A diagrammatic plan view of a radiant element according to the invention with a light radiator and a dark radiator.

FIG. 1 shows in plan view a radiant element 11, which has in a sheet metal shell a dish-shaped insulation 12. The rim 13 of said insulation is pressed onto the underside of a glass ceramic hotplate, so that the radiant element 11 forms a circular heating zone on said glass ceramic plate.

In the heating zone 14, which takes up the circular space within the rim 13, is provided a light radiator 15, which is in the form of an almost 360° circular tube and whose two ends are led parallel to one another to the outside. This quartz or quartz glass tube is sealed off at its two ends 16 and provided with electrical connections 17, which are connected to a multiply supported heating coil (not shown) located in the tube and which is made from tungsten or some other electrical resistance material which is resistant to high temperatures. The light radiator can also be polygonal or have other shapes. In the represented embodiment it passes round in the vicinity of the outer circumference of the heating zone and consequently creates in its interior a circular area, which is partly occupied by a dark radiator 18. As described in U.S. Pat. No. 4,700,051 (equivalent to European Patent No. 176,027), the disclosure of which is herein incorporated by reference, the dark radiator can comprise wire filaments formed from conventional resistance material, which are laid on the bottom of the insulation 12 in zig-zag or spiral form by conventional fixing means.

The ends 16 of light radiator 15 project outwards through the rim 13 and are provided there with electrical connections 17. Both the radiant elements 15 and 18 are spaced from the glass ceramic plate and the light radiator 15, optionally supported by the same, is spaced from the insulation 12. A rod-like temperature sensor 19 of a temperature limiter 20 passes diametrically over the entire heating zone 14.

In the diagrammatic plan view of FIG. 1 it is possible to see a damping resistor 21 located in the vicinity of heating zone 14. It can be a resistor similar to a dark radiator 18, but is subject to higher loading. Thus, in the case of a relatively high resistance value, it can be so dimensioned in length, diameter and arrangement that in permanent operation it would assume a fundamentally unacceptable temperature. The damping resistor can also be part of the heating means or in the form of a conventional resistance heating element of the radiant element. However, damping resistors are also suitable which have another configuration, e.g. ribbon, film or similar resistors. It is also possible to associate a thermal material with the damping resistor 21 and to which it is connected in heat conducting manner and which dissipates the heating occurring thereon in only surge-like manner and consequently evens out the same. Thus, an arrangement of a damping resistor outside the radiant element is possible.

Figure 2:
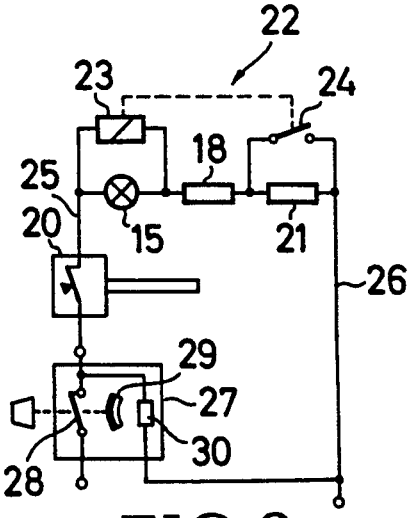

FIG. 2 shows a circuit of the radiant element according to FIG. 1. The light radiator 15 is continuously connected in series with the dark radiator 18 and in series with the latter is also connected the damping resistor 21. The voltage at both sides of the light radiator 15 is monitored by a damping switching device 22, which in the represented embodiment is shown as a voltage trip coil 23 in parallel with the light radiator 15, with a switching contact 24 operated by the trip coil. In the represented embodiment the attenuation or damping device comprises the damping resistor 21 and the damping switching device 22. The switching contact 24 bridges the damping resistor 21 when the switching contact is closed.

The switching contact of the temperature limiter and a timing power control device 27 are switched into one of the mains leads 25, 26. It is of the type generally known as an "energy regulator" and has a switching contact 28, which is operated in continuously adjustable manner by a bimetal 29, which is heated by a control heating means 30 connected in parallel to the radiant element.

After switching on the radiant element, the power control contact 28 and the contact of the temperature limiter 20 are closed, whereas contact 24 is open, because provisionally the voltage difference on both sides of the light radiator is low, because its internal resistance is still very low due to the cold filament. However, the two resistors 18 and 21 in series with the light radiator ensure that the starting current remains limited to an admissible value despite the low resistance in the light radiator 15. After heating the light radiator 15, which normally takes place within about 2 seconds, its resistance increases by approximately a power of 10 (normally 10 to 12 times), so that the voltage drop across it also rises and the damping switching device comes into action, e.g. sufficient current is applied to the relay coil 23 to attract and consequently close contact 24. Thus, the damping resistor 21 is bridged and only the light and dark radiators 15, 18 are connected in in series. If, through heating the bimetal 29, the power contact 28 opens, the complete arrangement becomes dead and consequently the voltage at switching device 22 drops to zero, so that contact 24 opens again. This is repeated during each timing cycle of the power control device 27 and the temperature regulator 20.

The arrangement operates without loss, because all the heat in the vicinity of the radiant element becomes free and the damping is so short and low that it hardly has any effect on effectiveness of the light radiator, which is intended to heat rapidly and give off the radiant heat.

This is illustrated by a mathematical example. It is assumed that in a radiant element with a total power of 2200 W are installed a 1100 W light radiator and a 1100 W dark radiator, in each case based on the operating state. The operating current is then at 220 V 10 A and the resistance of the radiators in each case 11 ohm, i.e. 22 ohm in series. While the temperature coefficient of the resistance in the case of the dark radiator is relatively low and was ignored for the purpose of this calculation, the high resistance temperature coefficient of the light radiator leads to a drop of the resistance in the cold state to 1/10 to 1/12, so that on assuming a mean value of 1/11, the cold resistance of the light radiator is only 1 ohm. On switching on the light and dark radiator without a damping resistor, the total resistance would be 12 ohm corresponding to a starting current of 18.3 A (=4 kW). This would be inadmissible even in the form of a brief peak current, which would reoccur in each control cycle, although in attenuated form, particularly if it is borne in mind that often several such radiant elements are contained in a cooker and in certain circumstances their starting currents can coincide.

In the case of the upstream connection of a damping resistor 21 of 10 ohm, the resistance of the series connection 15, 18, 21 increases to 22 ohm, which in the case of a 10 A starting current corresponds to 2200 W, i.e. it is no higher than the operating current. In the cold state the light radiator only initially consumes 100 W, whereas the dark radiator consumes 1100 W and the damping resistor briefly 1000 W. After fractions of a second this distribution has changed and through the rise in the resistance in the light radiator the power levels of the three resistors have stabilized in a very short time. There is no significant deterioration of the warming-up time.

Figure 3:
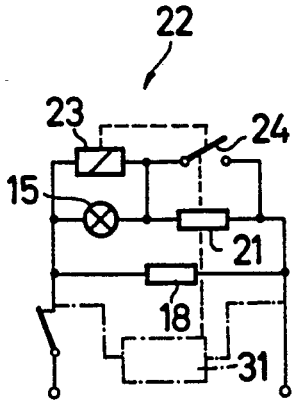
FIGS. 2 and 3: Circuit diagrams for such a radiant element.

FIG. 3 shows a circuit in which the light radiator 15 is connected in parallel with a dark radiator 18. In this case, in the above power distribution example, the light and dark radiators would in the operating state in each case have a resistance of 44 ohm, which in the cold state would drop to 4 ohm for the light radiator, so that the latter would in the cold state attract a current of 55 A equal to approximately 12 kW. Together with the dark radiator this would be 13 kW, which would be very unacceptable. A damping resistor of e.g. 40 ohm would limit the total power to 10 A or 2200 W and would create much the same heating conditions as described relative to FIG. 2.

Thus, in the case of FIG. 3 in the phase conductor or winding containing the light radiator, the damping resistor 21 is connected in series with the latter, while the dark radiator is in parallel thereto. The damping resistor 21 is once again bridged by a damping switching device 22.

The use of a parallel connection of light and dark radiators can be advantageous, because as a result the resistance of the heating coil in the light radiator can be higher, which as a result of a thinner filament can lead to advantages in the production of the light radiator, which also applies with regards to the dark radiator. It can also lead to a reduction in the response time until the full lighting intensity of the light radiator is reached.

In dot-dash line form is shown a delay circuit 31, which can be used in place of the switching device 23 responding to the voltage at the light radiator and which only closes the switching contact 24 opened on disconnecting the current after a set time. This time could e.g. be the standard warming-up time of up to approximately 2 seconds for the light radiator. Such a delay circuit could also be an electronic or thermal delay switch of known construction.

Figure 4:
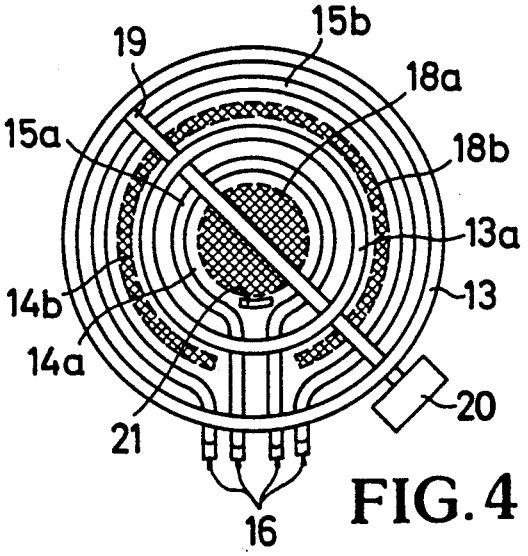
FIG. 4: A diagrammatic plan view of a radiant element with two light radiator and two dark radiator zones.

FIG. 4 shows a plan view of a two-circuit radiant element which, with an otherwise similar construction to FIG. 1, has an inner heating zone **14*a* and an outer heating zone 14*b*, which are bounded with respect to one another by an intermediate rim or edge 13*a*. A light radiator 15*a*, 15*b* and a dark radiator 18*a*, 18*b* is located in each heating zone. The outer light radiator can be constructed in such a way that its ends 16 are located on either side of the ends 16 of the inner light radiator 15*a* and the dark radiator 18*b* can be in the form of a circular ring optionally interrupted at the light radiator outlets. The damping resistor 21 can be located at a random point, e.g. in the present case in the central heating zone 14*a***.

Figure 5:
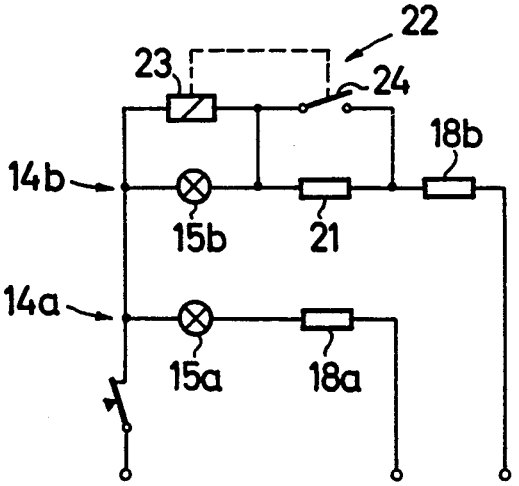
FIG. 5: A circuit arrangement for such a two-circuit radiant element.

The circuit according to FIG. 5 shows that the series connection of light radiator **15*a* and dark radiator 18*a* belonging to the central heating zone 14*a* has no damping resistor, whereas the damping resistor 21 is associated with heating zone 14*b* and the heating resistor combination 15*b*, 18*b* is switched in in series. A damping device 22 of the aforementioned type switches the damping resistor 21 off by short-circuiting it following the warming-up phase of the light radiator 15*b***.

The control or switching can be as described relative to FIG. 2. However, an additional switch (not shown) is provided enabling, when necessary, the connection of the outer heating zone **14*b* to the inner heating zone, which is always in operation on switching on the radiant element. The inner heating zone generally has a smaller capacity, so that possibly the damping by the series connection of the dark radiator 18*a* may be adequate here, whereas the outer heating zone has a higher capacity and consequently the damping resistor ensures an adequately low starting current. It is also possible to avoid the simultaneous starting current peaks of both light radiators in such two-circuit radiant elements by a delay circuit acting between the two heating zones 14*a*, 14*b*** which, even in the case of the immediate switching on of the two heating zones, allows these to come into action reciprocally staggered by a short time, e.g. 1 or 2 seconds, so that the starting current peaks do not occur simultaneously.

Figure 6:
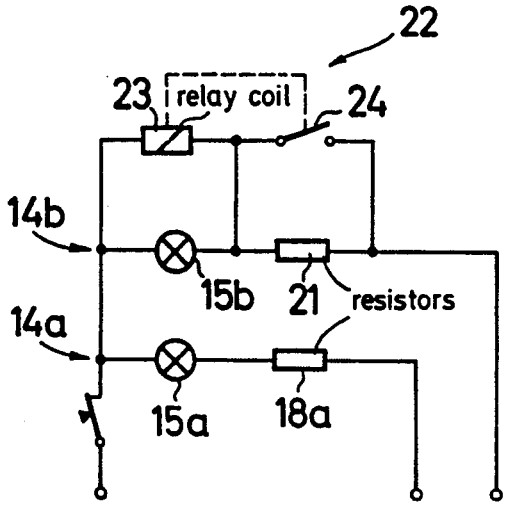
FIG. 6: A circuit arrangement for a two-circuit radiant element with only one series resistor and a separate damping resistor.

FIG. 6 shows a circuit arrangement for a two-circuit radiant element, in which a dark radiator **18*a* in series with the light radiator 15*a* is only associated with the inner heating zone 14*a*, while the outer heating zone 14*b* only contains a light radiator 15*b*, with which is associated a damping resistor 21**, which is switched in the described manner.

Figure 7:
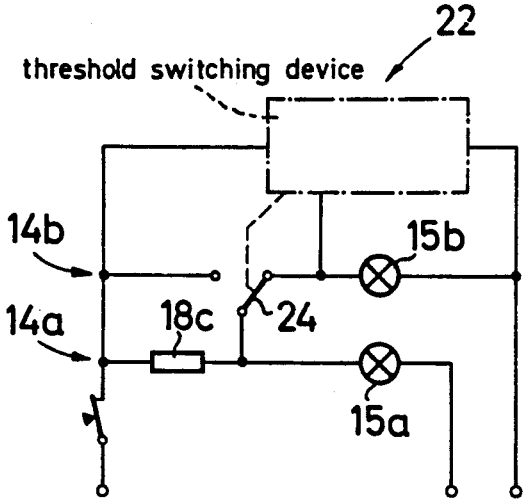
FIG. 7: A circuit of such a radiant element without a separate damping resistor.

FIG. 7 shows a construction of the same type, but here no separate damping resistor is provided and instead, on switching on the dark radiator **18*c* of the inner heating zone 14*a* is connected in series with the two light radiators 15*a* and 15*b***.

Figure 8:
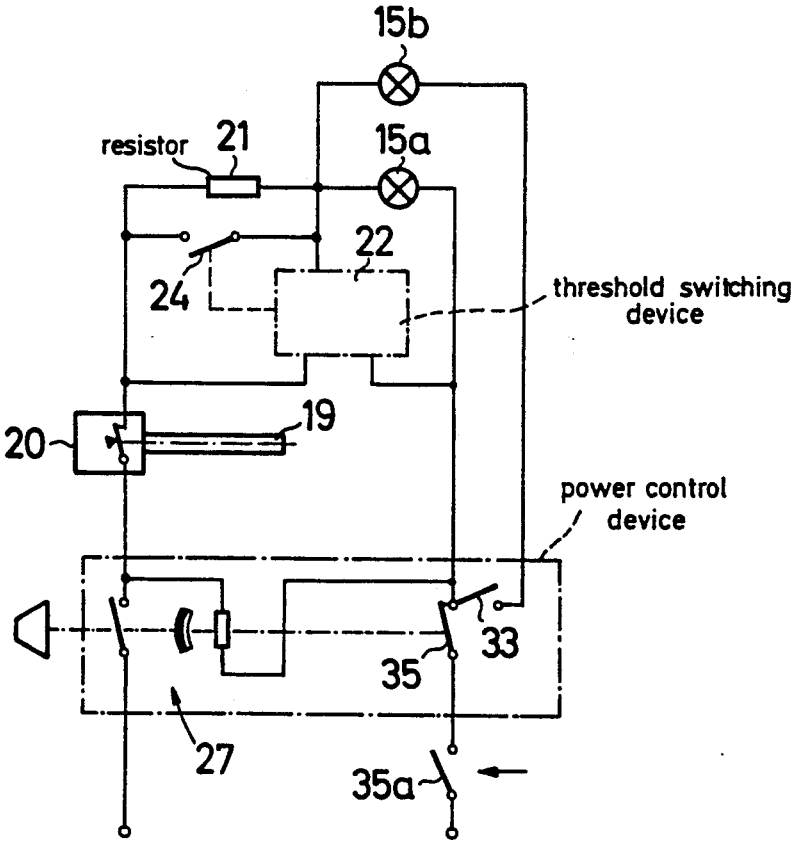
FIG. 8: A circuit of a radiant element with two light radiators and no permanent dark radiator.

The damping circuit is here an electronic damping circuit, which is preferred to a relay with voltage coil, because this reliably prevents any flutter phenomena in the switching range by a corresponding stable threshold circuit. Such electronic circuits are generally known. They can be designed in such a way that after responding once (exceeding the voltage threshold) a disconnection only takes place after the complete phase conductor or winding has been switched in voltage-free manner. This can take place with an additional switch, as shown in FIG. 8 by reference numeral **35*a*. The function of the additional switch could also be assumed by the power control device contact. An electronic threshold switching device 22 can also respond to criteria other than the voltage difference at the light radiator or the time. For example, a switching device would be conceivable, which operates the damping device as a function of the direct effect of the light radiator, namely its light emission. In this case the device could be controlled by a photodiode or the like. Although the damping switching device forms part of the radiant element, it is preferably (except for the damping resistor) positioned outside the radiant element, e.g. on its outside or at other points of the cooker. In the case of FIG. 7 the damping switching device 22 operates a contact 24, which is constructed as a changeover contact and simultaneously interrupts the line branch of the outer heating zone 14*b*, when it switches on the light radiator 15*b* in the described manner in the line branch of the inner heating zone 14*a***.

FIG. 8 shows a construction in which there is only one damping resistor 21 for two light radiators **15*a*, 15*b* and it is connected in series with the same and can be bridged by a device 22, as described relative to FIG. 7. The power control once again takes place with a timing power control device 27 which, as has already been stated, can additionally operate a contact 34*a* which, on switching on the external heating circuit, simultaneously makes the entire circuit arrangement voltage-free and consequently reactivates the threshold switch contained in the damping switching device. This disconnection could also be carried out by the manual switch 35. The external heating zone can, if necessary, be switched on by means of switch 33. Thus, the electronic switching device 22 also comes into action on switching in the light radiator 15***b* to the already operated light radiator 15*a*, so that then briefly the damping resistor 21 is switched on again. Advantageously the damping device reduces somewhat the optical effect of the light radiator, particularly in the case of timing cyclic control.

What is claimed is:

1. A radiant element, particularly for glass ceramic hotplates, comprising:

means for coupling the radiant element to a source of electrical energy;

the radiant element defining a heating area;

at least two electric visible light radiator heating means connected in parallel and arranged in different heating zones of said heating area;

selection switching means for selectively switching one or both of said heating means in said different heating zones to said source;

temporarily operable damping means for damping energization of the heating means for a limited time following each switching in of the heating means, said damping means having a resistor located in said heating area; and, means for connecting said resistor in series with both said heating means in said different zones for said limited time and disconnecting said resistor when said limited time has elapsed, whereupon both heating means are connected without an interconnected series resistor to said source of energy.

2. The radiant element according to claim 1, wherein the damping switching means acts as a function of a voltage drop across the light radiator means and contains threshold switching means responding to the voltage drop.

3. The radiant element according to claim 2, wherein the threshold switching means include an electronic circuit triggered by reaching a desired voltage.

4. The radiant element according to claim 3, wherein the threshold switching means are reactivated by disconnection from the source.

5. The radiant element according to claim 4 wherein disconnecting means is operatively associated with the selection switching means for disconnecting the source from the threshold means upon switching of the second of said both heating means.

6. The radiant element according to claim 1, wherein the damping means acts during each timing cycle of control means including at least one of a timing power control means and a temperature limiter.

7. The radiant element according to claim 1, wherein the damping means contains a delay circuit.

* * * * *